US007802610B2

(12) United States Patent
Brown

(10) Patent No.: US 7,802,610 B2
(45) Date of Patent: Sep. 28, 2010

(54) RETRACTABLE CLOSURE APPARATUS FOR MOBILE CONTAINERS

(76) Inventor: Robert Brown, 2217 Newport Dr., Naperville, IL (US) 60565

( * ) Notice: Subject to any disclaimer, the term of this patent is extended or adjusted under 35 U.S.C. 154(b) by 0 days.

(21) Appl. No.: 09/951,496

(22) Filed: Sep. 13, 2001

(65) Prior Publication Data

US 2002/0139493 A1 Oct. 3, 2002

Related U.S. Application Data

(60) Provisional application No. 60/279,465, filed on Mar. 28, 2001.

(51) Int. Cl.
*A47G 5/02* (2006.01)

(52) U.S. Cl. ..... 160/313; 160/323.1; 160/328; 248/251

(58) Field of Classification Search ..... 160/120, 160/70, 79, 243, 328, 294, 267, 313, 323.1, 160/395, 903; 248/251, 252, 499; 135/89
See application file for complete search history.

(56) References Cited

U.S. PATENT DOCUMENTS 3,719,220 A * 3/1973 Small ..... 160/108
3,866,874 A * 2/1975 Upton, Jr. ..... 248/251
4,351,072 A * 9/1982 Smith ..... 4/503
4,373,569 A * 2/1983 Barettella ..... 160/263
4,413,665 A * 11/1983 Corcoran ..... 160/315
4,590,642 A * 5/1986 Hesener ..... 16/241
4,673,017 A * 6/1987 Lauzier ..... 160/22
4,729,418 A * 3/1988 Rude ..... 160/323.1
5,119,867 A * 6/1992 Lukos ..... 160/70
5,230,494 A * 7/1993 Adams ..... 248/266
5,450,891 A * 9/1995 Benthin ..... 160/323.1
5,495,884 A * 3/1996 Shikler ..... 160/120
5,857,653 A * 1/1999 Dujlovich ..... 248/267
5,881,792 A * 3/1999 Cheng ..... 160/263
6,101,675 A * 8/2000 Goldstein ..... 16/94 D
6,164,428 A * 12/2000 Berman et al. ..... 192/223.4
6,338,521 B1 * 1/2002 Henning ..... 296/100.15

* cited by examiner

*Primary Examiner*—Bruce A. Lev
(74) *Attorney, Agent, or Firm*—Tyrone Davis; John S. Kendall; Davis & Kendall, PC

(57) ABSTRACT

An apparatus for the safe closure of the open area of mobile containers, having a tarp connected to a spring loaded tarp assembly and to the container by brackets. These brackets allow the tarp to be lowered and raised using the spring loaded tarp assembly. A metal plate at the bottom of the tarp is used to secure the bottom of the trap while in the closed position. The spring loaded tarp assembly comprises three main components a sleeve, a rod, and tension springs. The rod allows the free flow rotation of the sleeve with the tension spring acting as a back stop.

11 Claims, 5 Drawing Sheets

RETRACTABLE CLOSURE APPARATUS FOR MOBILE CONTAINERS

CROSS REFERENCE TO RELATED APPLICATIONS

This invention was originally disclosed in provisional application No. 60/279,465 filed on, Mar. 28, 2001. The inventor claims all rights and priorities associated with the provisional application.

FIELD OF THE INVENTION

This invention relates to an apparatus for the safe closure of the open area of mobile containers. More particularly, to a retractable tarp arrangement providing a more secure closure assemble and that is easily retrofitted to existing mobile containers. Thereby reducing the rate of failure perpetuating a savings from loss of down time and cost of recovery.

BACKGROUND OF THE INVENTION

In the waste disposal industry the trend since the late 1970's has been to reduce the acreage used for waste disposal. As a result, trash compacting and recycling are standard means to create these reductions. Compacting is one way by which not only a reduction in waste acreage is gained but is also creates a reduction in on site storage between pickups.

On site compacting usually occurs in the rear of a facility and consists of an industrial compactor attached to a mobile container. In operation, the compactor is loaded with the waste material and compacts it to a block of waste. Once compacted a large ramrod pushes the solid block of waste into a giant mobile container. This block of waste loosens during storage and transport. The mobile container consists of a steel container having a large rear hinged door, with a predetermined open area for ramming the solid block of waste into the container.

Once loaded, an operator attaches a tarp to cover the open area. This is accomplished by using bungee cords, rope, or the like. Bungee cords are elastic cords having metal hooks attached at both ends. These cords are attached to the container vertically and horizontally across the tarp. Upon closing, the mobile container is loaded unto a trailer and hauled off to a waste disposal site. The used of the tarp and the bungee cords present several problems. The first is that the use of the cords are not reliable and fail frequently. An operator must be careful when attaching the cords in that they can easily cause injury. Finally, during transport a failure can cause delay and added expense as waste product can be lost along the route. Missing or improperly attached cords on a mobile container are the major causes of transport mishap and delay.

Researchers have yet to adequately address the need for a lightweight, safe, and secure closure means for mobile containers. As shown in U.S. Pat. No. 6,196,590 issued to Kim, the slide hatch cover for a bulk carrier vehicle requires a ramrod and heavy hatch cover.

U.S. Pat. No. 6,007,138 issued to Cramaro discloses a tarpaulin cover system which a cable pulley arrangement for covering the top of a vehicle bed. This system requires that the operator hand crank the tarp into position over the top of the truck bed.

The present invention is a solution and a safe closure means for the open area of mobile containers. The tarp is easily extended across the open area of the mobile container and retracted by an inner spring mechanism.

SUMMARY OF THE INVENTION

The present invention provides a lightweight closure means for mobile waste containers. The retracting tarp arrangement is easily retrofitted on existing containers and is a safe and secure closure means allowing for a one-man operation.

It is an object of the invention to provide a secure closure apparatus for mobile waste containers.

It is another object of the invention to provide a lightweight closure means allowing for a one-man operation.

It is also an object of the invention to reduce the number of man hours due to securing the tarp to mobile containers.

Another object is to reduce the number of transport incidents due to closure failures on waste containers.

It is an object of the invention to provide a low cost closure system which is easily retrofitted on existing mobile waste containers.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the invention comprises a tarp connected to a spring loaded rod and to the container by brackets. These brackets allow the tarp to be lowered and raised using a spring loaded tarp assembly. A metal plate at the bottom of the tarp is used to secure the bottom of the trap while in the closed position. The spring loaded tarp assembly comprises three main components a sleeve, a rod, and tension springs. The rod allows the free flow rotation of the sleeve with the tension spring acting as a back stop. Therefore, as you lower the tarp, which is attached to the sleeve and secure it to the bottom of the mobile container, the spring incurs tension. Upon release, the springs assists in raising the tarp.

Other features and advantages of the present invention will be apparent from the following description in which the preferred embodiments have been set forth in conjunction with the accompanying drawings.

BRIEF DESCRIPTION OF THE DRAWINGS

The accompanying drawings, which are incorporated in and form part of the specification, illustrate an embodiment of the of the present invention and together with the description, serve to explain the principles of the invention. In the drawings.

DETAILED DESCRIPTION OF THE INVENTION

Figure 1:
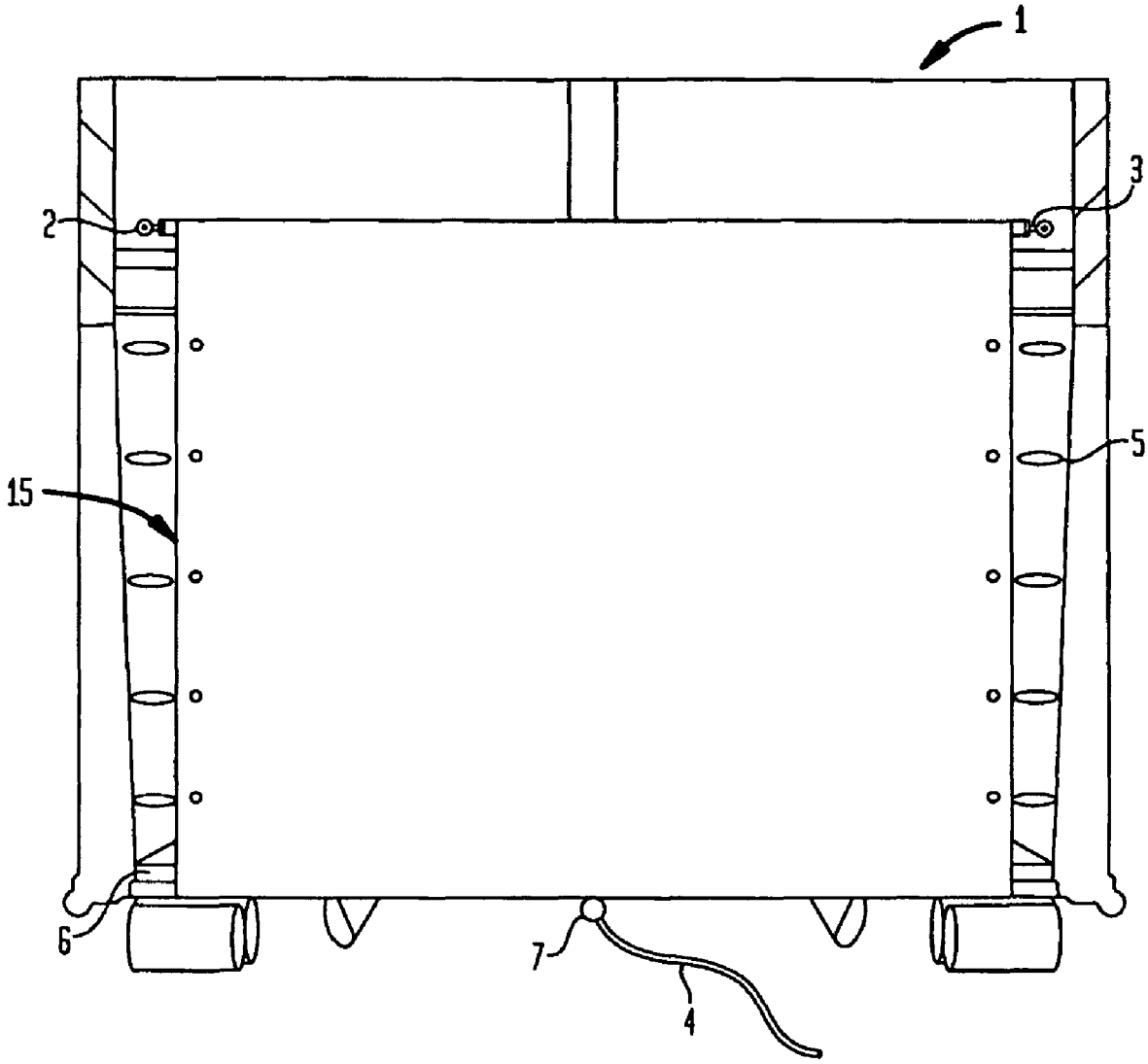
FIG. 1 shows the retractable tarp on a mobile container.
Figure 2:
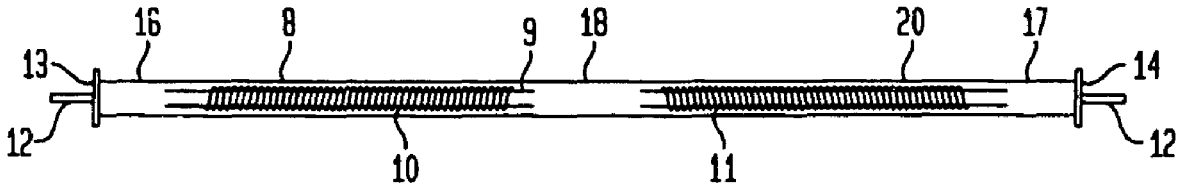
FIG. 2 shows a detail of the retractable tarp assembly.

Referring to FIG. 1, a mobile container (1) is shown having a retractable tarp (4) connected to the container (1) by brackets (2, and 3). These brackets allow the tarp (4) to be lowered and raised. A metal plate (6) at the bottom of the tarp (4) is used to secure the bottom of the tarp (4) to the container (1) while in the closed position. As shown in FIG. 2, the retractable tarp assembly (20) comprises a sleeve (8), end caps (13 and 14) a rod (9), left and right bushings (16 and 17), a center bushing (18), and tension springs (10 and 11). The rod (9) allows the free flow rotation of the sleeve (8) with the tension springs (10 and 11) acting as a back stop. Therefore, as you lower the tarp (4) and secure it to the bottom of the mobile container (1) the springs (10 and 11) incur tension whereby, upon release, the springs (10 and 11) create a back pull and assists in rotating the sleeve (8) and raising of the tarp (4).

Figure 3:
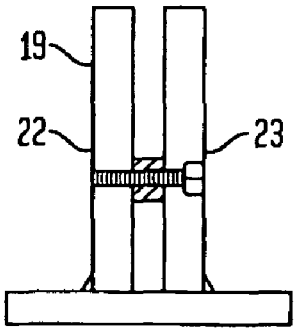
FIG. 3 shows a detail of the bracket.
Figure 4:
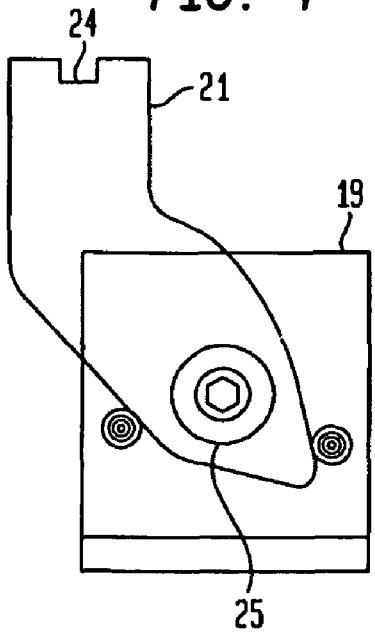
FIG. 4 shows a detail of the bracket and lever.
Figure 5:
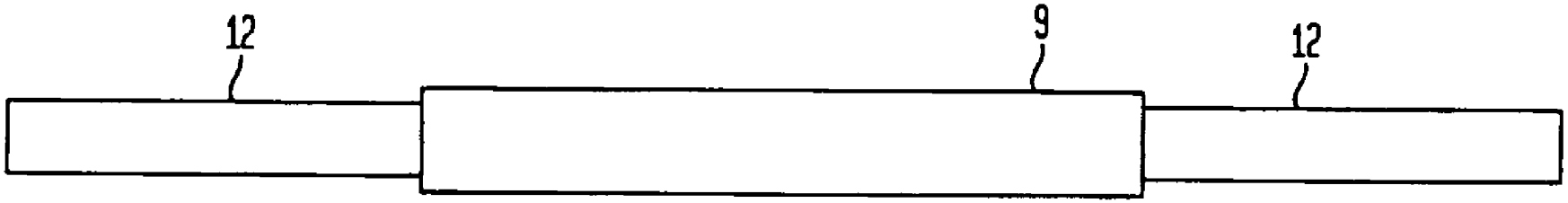
FIG. 5 shows the rod.
Figure 6:
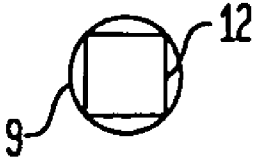
FIG. 6 shows a side profile of the rod.
Figure 7:
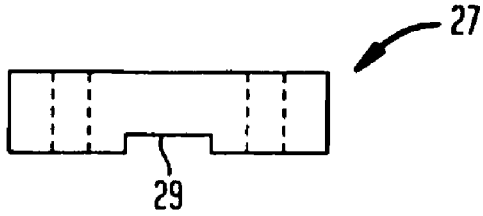
FIG. 7 shows the front of the secure piece.
Figure 8:
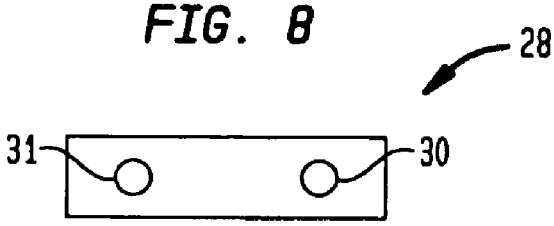
FIG. 8 shows the top of the secure piece.

FIGS. 3 and 4 show detail of the brackets (2 and 3). The bracket (19) has a bracket lever (21) positioned within the bracket (19) left and right flanges (22 and 23). The bracket lever (21) has a smooth flat area (24) with sides at 90° angles adapted to accept the square ends of the rod (9). The bracket lever (21) has a center bearing arrangement (25) which attaches it to the bracket (19) and allows it to rotate around its center point. The bracket lever's (21) ability to rotate up to 220° allows the retractable tarp assembly (20) to be easily moved out of position when not in use. FIGS. 5 and 6 show details of the rod (9) and its square ends (12) which fit into the brackets (2, and 3). FIGS. 7 and 8 show the front of the secure piece (27), and the top of the secure piece (28). It has a smooth surface (29) with sides at 90° angles to accept the square rod ends (11). The rod (9) attaches to the brackets (2, and 3) and is adapted to receive screws (30 and 31).

Figure 9:
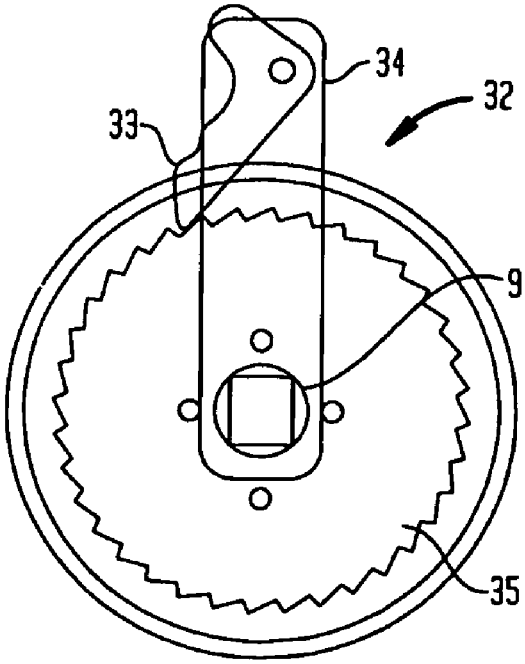
FIG. 9 shows the ratchet assembly.
Figure 10:
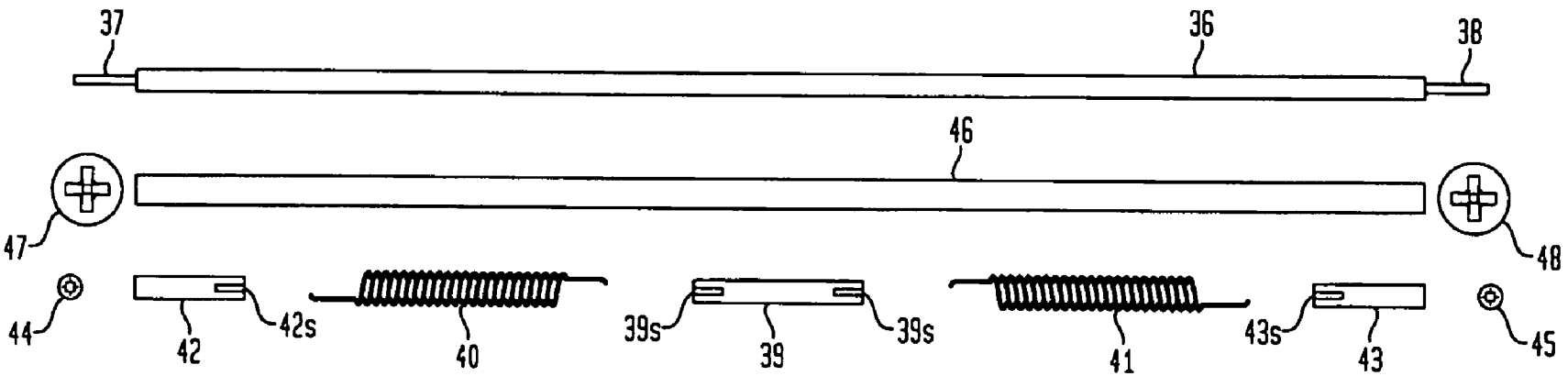
FIG. 10 shows an exploded view of the retractable tarp assembly.

FIG. 9 shows a rachet assembly (32) which can be used to lock the tarp (4) in position. It comprises a prawl (33) attached to holder (34). The holder (34) and a ratchet (35) are connected to one of the end caps (13 and 14) and the rod (9), whereby as the rod (9) turns the prawl (33) and ratchet (35) engages in one direction when the rod (9) stops moving. Finally, the sides of the tarp (4) use rachet cables (5) to secure them to the container.

In the preferred embodiment, the rod (36) has square ends (37 and 38). The center bushing (39) is secured and centered on the rod (36) the center bushing (39) has slots (39*s*) on each end to receive tensioning springs (40 and 41). The left and right bushings (42 and 43) have similar slots (42*s* and 43*s*) on one end to receive the tensioning springs (40 and 41). These slots may also be replaced by threaded ends (not shown) on each bushing (39, 42, and 43). Matching borings (not shown) along the bushings (39, 42, and 43) allow the bushings to be secured to the rod (36) and sleeve (46) with screws. Rod retainers (44 and 45) are attached to the left and right bushings (42 and 43). The sleeve (46) surrounds the rod (36) and bushings (39, 42, and 43). End caps (47, and 48) have openings to allow the rod (36) to pass throught, while closing off the ends of the sleeve (46). Thus allowing the sleeve (46) to spin independently. The foregoing description of the preferred embodiment of the invention has been presented for purposes of illustration and description. It is not intended to be exhaustive or to limit the invention to the precise form disclosed, and obviously many modifications and variations are possible in light of the above teaching.

The embodiments of the invention in which an exclusive property or privilege is claimed are defined as follows:

1. An apparatus for the closure of a container comprising:

left and right brackets, said left and right brackets further comprises a smooth flat surface having left and right ends and said left and right ends extending at a 90° angle from said smooth flat surface;

a rod connected to said left and brackets and said rod has a tubular shape having a left and right end and said ends each having a section with parallel sides and each at 90° angles from the other; and a bushing assembly attached to said rod and encircling its circumference comprising, a center bushing wherein said center bushing is connected to said rod, and the center bushing further comprising a slot on each end whereby the left and right springs are attached therethrough, a left spring connected to said center bushing at one end, a right spring connected to said center bushing at the other end, a left bushing connected at one end to said left spring, a right bushing connected at one end to the right spring, a sleeve member connected to said bushing assembly, and a tarp attached to said sleeve.

2. The apparatus as recited in claim 1 wherein said rod left and right ends are positioned within the left and right brackets respectively, said rod ends rest on said smooth flat surface of said brackets, and said left and right sides of each of the brackets surround at least two of said parallel sides of the rod ends.

3. The apparatus as recited in claim 2 wherein said left and right bushings each have a slot on one end to receive and connect with said left and right springs respectively, said left and right bushings having a retaining piece positioned at the opposite ends from said left and right springs respectively and said retaining piece having an opening allowing said rod ends to extend freely.

4. The apparatus as recited in claim 3 wherein said sleeve is a hollow cylinder and is connected to said left and right bushings, and the tarp is attached to the circumference of the cylinder.

5. The apparatus as recited in claim 4 wherein said left and right brackets further comprise a securing piece, said securing piece having a smooth flat surface with a left and right side extending a 90° angle from said smooth flat surface, and said secure piece is positioned around said parallel sides of said left and right rod ends.

6. The apparatus as recited in claim 5 wherein said left and right brackets comprise:

a base;

a left and right flange member connected to said base;

a lever member connected allowing free rotation for up to 220°.

7. A method of opening and closing an opening of a mobile container comprising the steps of:

a). attaching left and right brackets on said container wherein said left and right brackets comprise a base, a left and right flange member connected to said base, a lever member connected to the left and right flange members and allowing free rotation for up to 220';

b). connecting one end of al tarp assembly to said left and right brackets; said tarp assembly further comprising a tarp attached to the sleeve, a rod, a bushing assembly attached to said rod and encircling its circumference a sleeve member connected to said bushing assembly;

c). extending said tarp across said opening of said mobile container whereby as said tarp is pulled the tarp assembly has the ability to impart tension on said sleeve;

d). securing the other end of said tarp to the mobile container;

e). releasing said tarp whereby said tarp assembly releases the tension on the sleeve causing the tarp to be wound around the sleeve.

8. The method as recited in claim 7 wherein said bushing assembly further comprises:

a center bushing;

a left spring connected to said center bushing at one end;

a right spring connected to said center bushing at the other end;

a left bushing connected at one end to said left spring; and;

a right bushing connected at one end to the right spring.

9. The method as recited in claim 8 wherein said left and right bushings each have a slot on one end to receive and connect with said left and right springs respectively, said left and right bushings having a retaining piece positioned at the opposite ends from said left and right springs respectively and said retaining piece having an opening allowing said rod ends to extend freely.

10. The method as recited in claim 9 wherein said rod has a tubular shape with a left and right end, and said ends each having a section with parallel sides each at 90° angles from the other.

11. The method as recited in claim 10 wherein said sleeve is a hollow cylinder and is connect to said left and right bushings, and the tarp is attached to the circumference of the cylinder.

* * * * *